US006083325A

United States Patent [19]

Bitoh et al.

[11] Patent Number: 6,083,325

[45] Date of Patent: Jul. 4, 2000

[54] METHOD FOR MAKING FE-BASED SOFT MAGNETIC ALLOY

[75] Inventors: Teruo Bitoh; Yasuo Hayakawa; Takashi Hatanai; Akihiro Makino, all of Niigata-ken; Akihisa Inoue; Tsuyoshi Masumoto, both of Miyagi-ken, all of Japan

[73] Assignee: Alps Electric Co., Ltd., Tokyo, Japan

[21] Appl. No.: 08/893,768

[22] Filed: Jul. 11, 1997

[30] Foreign Application Priority Data

Jul. 15, 1996 [JP] Japan ..... 8-185210

[51] Int. Cl.[7] ..... H01F 1/147

[52] U.S. Cl. ..... 148/121; 148/305

[58] Field of Search ..... 148/121, 301, 148/122, 305, 304

[56] References Cited

U.S. PATENT DOCUMENTS 4,881,989 11/1989 Yoshizawa et al. ..... 148/302
5,069,731 12/1991 Yoshizawa et al. ..... 148/305
5,160,379 11/1992 Yoshizawa et al. ..... 148/108
5,252,148 10/1993 Shigeta et al. ..... 148/108
5,591,276 1/1997 Yoshizawa et al. ..... 148/304
5,611,871 3/1997 Yoshizawa et al. ..... 148/108

*Primary Examiner*—John Sheehan
*Attorney, Agent, or Firm*—Brinks Hofer Gilson & Lione

[57] ABSTRACT

A method for making a Fe-based soft magnetic alloy where an alloy melt is injected onto a moving cooling unit to form an amorphous alloy ribbon. The alloy melt contains Fe as a main component, B and at least one metallic element M selected from the group consisting of Ti, Zr, Hf, V, Nb, Ta, Mo and W, the composition of the alloy melt being selected such that the resulting amorphous alloy ribbon is characterized by a first crystallization temperature at which fine grain bcc Fe crystallites precipitate, and a second crystallization temperature at which a compound phase containing Fe—B and/or Fe—M precipitates. The amorphous alloy ribbon is then annealed at a temperature which is higher that the first crystallization temperature and less than the second crystallization temperature for an annealing time in the range of 0 minutes to 20 minutes.

2 Claims, 10 Drawing Sheets

METHOD FOR MAKING FE-BASED SOFT MAGNETIC ALLOY

BACKGROUND OF THE INVENTION

1. Field of the Invention

The present invention relates to methods for making soft magnetic alloys used in magnetic heads, transformers and choke coils.

2. Description of the Related Art

Soft magnetic alloys used in cores of magnetic heads, magnetic cores of pulse motors, transformers and choke coils generally require high saturation magnetic flux density, high permeability, low coercive force, formability into thin shapes, and low magnetostriction. Various alloys have been researched as soft magnetic materials satisfying such requirements.

Crystal alloys, such as Fe—Si—Al alloys (sendust alloys) and Fe—Si alloys (silicon steels), have been used in such soft magnetic applications. In addition, Fe- and Co-based amorphous alloys have recently been used.

Soft magnetic alloys are primarily used in the shape of a ribbon in various electronic instruments. A typical method for producing a soft magnetic alloy ribbon is a quenching process in which a melted alloy is injected or sprayed onto a cooling unit rotating at high speed to quench the alloy.

The soft magnetic alloy obtained by such a quenching process is substantially amorphous and annealed at a temperature higher than its crystallization temperature for approximately 1 hour to form a crystal phase in the amorphous phase, as disclosed in U.S. Pat. No. 4,881,989, in order to impart excellent magnetic characteristics, i.e., high saturation magnetic flux density and permeability, high hardness and excellent heat resistance to the soft magnetic alloy.

However, trends toward mass production of more compact high-performance instruments require methods for making soft magnetic alloys having superior magnetic characteristics, and in particular, higher permeability with higher productivity.

SUMMARY OF THE INVENTION

It is an object of the present invention to provide a method for making a soft magnetic alloy having superior magnetic characteristics with high productivity.

A method for making a Fe-based soft magnetic alloy in accordance with the present invention comprises steps of:

injecting an alloy melt comprising Fe as a primary component, B and at least one metallic element M selected from the group consisting of Ti, Zr, Hf, V, Nb, Ta, Mo and W onto a moving cooling unit to form an amorphous alloy ribbon; and annealing the amorphous alloy ribbon at an annealing temperature higher than the first crystallization temperature, in which a first crystal phase precipitates, and less than the second crystallization temperature, in which a second crystal phase precipitates, for an annealing time in a range of 0 minutes to 20 minutes to precipitate a fine grain phase having an average grain size of 30 nm or less, in which at least 50% of the grain phase comprises (bcc) Fe crystallites.

The annealing time more preferably ranges from 0 minutes to 10 minutes.

The annealing temperature preferably ranges from 500° C. to 800° C.

The alloy is preferably heated to the annealing temperature at a heating rate of 20° C./min. to 200° C./min.

DESCRIPTION OF THE PREFERRED EMBODIMENTS

Figure 1:
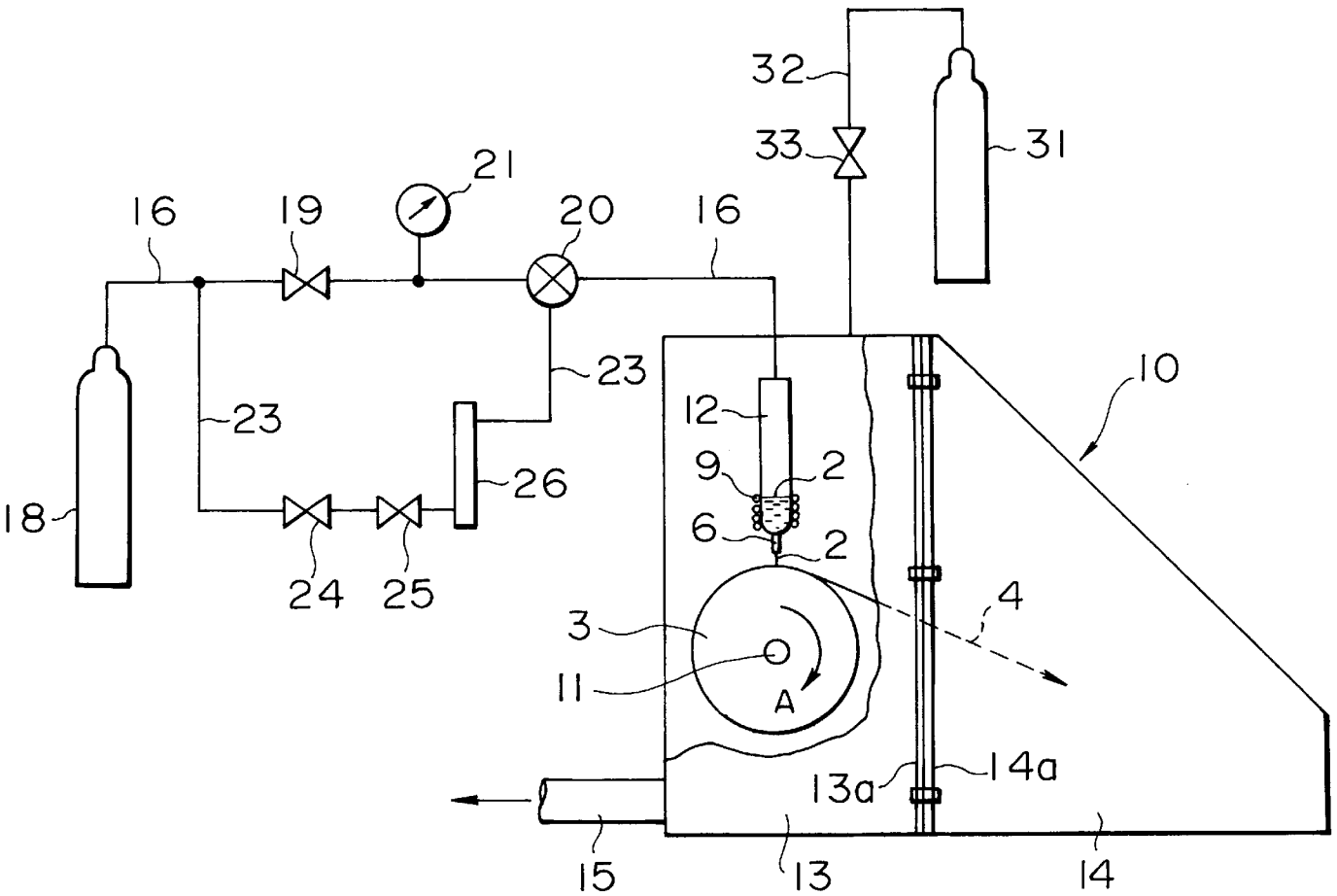
FIG. 1 is a schematic view of an embodiment of an apparatus for making an alloy ribbon.

The present invention will now be described in detail with reference to the drawings.

A first step of a method for making a Fe-based soft magnetic alloy in accordance with the present invention includes formation of an amorphous alloy ribbon by quenching an alloy melt comprising Fe as a primary component, B and at least one metallic element M selected from the group consisting of Ti, Zr, Hf, V, Nb, Ta, Mo and W. The alloy ribbon can be produced by a known method, for example, injection of the alloy melt onto a moving cooling unit, such as a cooling roller rotating at high speed.

The amorphous alloy ribbon is annealed at an annealing temperature higher than the first crystallization temperature, in which a first crystal phase precipitates, and less than the second crystallization temperature, in which a second crystal phase precipitates, for an annealing time in a range of 0 minutes to 20 minutes. Herein, the annealing temperature refers to the maximum temperature during annealing and the annealing time refers to the time in which the annealing temperature is held. The alloy ribbon after quenching has a microstructure essentially consisting of an amorphous phase. Annealing of such an amorphous ribbon at a given temperature precipitates a fine grain phase composed of (bcc) Fe crystallites having an average grain size of 30 nm or less. Herein, the temperature, in which in which a (bcc) Fe-base fine grain phase precipitates, refers to the first crystallization temperature. The first crystallization temperature depends on the composition of the alloy and generally ranges from 480 to 550° C.

At a temperature higher than the first crystallization temperature, a compound phase, such as $Fe_3B$ or $Fe_3Zr$ when the alloy contains Zr, precipitates as a second crystal phase and deteriorates the soft magnetic characteristics of the alloy ribbon. Herein, the temperature causing precipitation of such compound phase refers to the second crystallization temperature. The second crystallization temperature depends on the composition of the alloy and generally ranges from 740 to 810° C.

Therefore, the preferable annealing temperature of the amorphous alloy ribbon in accordance with the present invention ranges from 500° C. to 800° C. and is determined based on the composition of the alloy so that a fine grain phase essentially consisting of (fcc) Fe crystallites precipitates and the compound phase does not precipitate.

In the amorphous alloy ribbon in accordance with the present invention, high permeability can be achieved at a shorter annealing time of 20 minutes or less, and even at 0 minutes in some alloys (that means cooling immediately after heating without annealing time). High permeability can be achieved at a further shortened annealing time of 10 minutes or less for alloys not containing Cu and Si, and in particular not containing Si. Alloys containing Si require longer annealing times for sufficiently dissolving Si into Fe. Additional annealing times in Si-containing alloys are not preferable because magnetic characteristics do not improve any more and productivity decreases due to a longer production time periods. Furthermore, excessive annealing times will readily cause nucleation due to an inhomogeneous component distribution. Such nucleation will cause a non-uniform grain size although the average grain size does not noticeably change, and thus will deteriorate magnetic characteristics.

The heating rate of the amorphous alloy ribbon from room temperature to the annealing temperature is in a range of generally 20° C./min. to 200° C./min., and preferably 40° C./min. to 200° C./min. Although it is preferable that the heating rate be as high as possible in view of productivity, it is difficult to achieve a heating rate over 200° C./min. due to restrictions in current apparatus performance. After annealing, the alloy ribbon is cooled by air cooling or the like.

Such a method for making the soft magnetic alloy in accordance with the present invention permits precipitation of a fine grain phase having an average grain size of 30 nm or less, in which at least 50% of the grain phase comprises (bcc) Fe crystallites, without precipitation of the compound phase, such as $Fe_3B$, deteriorating soft magnetic characteristics. A combination of such a crystal phase consisting of fine grains and an amorphous phase present at the grain boundary can provide superior soft magnetic characteristics.

A reason for superior soft magnetic characteristics of the alloy in accordance with the present invention is that crystal magnetic anisotropy is equalized by means of magnetic interaction between bcc grains and apparent crystal magnetic anisotropy significantly decreases. It is considered that crystal magnetic anisotropy is one of factors which deteriorates soft magnetic characteristics in conventional crystalline materials consisting of fine bbc crystal grains.

When the average crystal grain size of the alloy exceeds 30 nm, the crystal magnetic anisotropy cannot be sufficiently equalized and thus soft magnetic characteristics deteriorate. Further, less than 50% of fine grain phase decreases magnetic interaction between grains and deteriorates soft magnetic characteristics.

Each of preferred soft magnetic alloys is composed of Fe as the primary component, B and at least one element M selected from the group consisting of Ti, Zr, Hf, V, Nb, Ta, Mo and W.

In particular, preferred soft magnetic alloys are represented by the general formula $Fe_bB_xM_y$, $Fe_bB_xM_yX_z$, $Fe_bB_xM_yT_d$, and $Fe_bB_xM_yT_dX_z$ wherein T is at least one element selected from the group consisting of Cu, Ag, Au, Pd and Pt, X is at least one element selected from the group consisting of Si, Al, Ge and Ga, the composition ratios, b; x, y, d and z are in ranges of $75 \leqq b \leqq 93$ atomic percent, $0.5 \leqq x \leqq 18$ atomic percent, $4 \leqq y \leqq 9$ atomic percent, $d \leqq 4.5$ atomic percent, and $z \leqq 4$ atomic percent, respectively.

The amount of Fe represented by suffix b in these soft magnetic alloys is 93 atomic percent or less. At an Fe content b over 93 atomic percent, a single amorphous phase is barely formed by a liquid quenching process, and a homogeneous alloy microstructure essential for high permeability cannot be achieved by the following annealing process. Further, it is preferable that the Fe content b be 75 atomic percent or more in order to achieve a saturation magnetic flux density of 10 kG or more. Thus, the Fe content b is in a range of 75 to 93 atomic percent. A fraction of Fe can be replaced with Co or Ni for the purpose of adjusting magnetostriction. In this case, Fe is replaced with such an element by preferably 10% or less, and more preferably, 5% or less. When Fe is excessively replaced, permeability of the alloy decreases.

It is considered that B enhances formation of the amorphous phase in the soft magnetic alloy, prevents coarsening of the crystal structure and suppresses formation of the compound phase adversely affecting magnetic characteristics in the annealing step.

Although Zr and Hf are not substantially dissolved in α-Fe, these components can be excessively dissolved by quenching and the whole of alloy to be amorphous state. The excessively dissolved components are partially crystallized by annealing to form a fine grain phase. The fine grain phase improves magnetic characteristics of the soft magnetic alloy and decreases magnetostriction of the alloy ribbon. The presence of the amorphous phase which inhibits growth of crystal grains in the grain boundaries is essential to suppress coarsening of the crystal grains.

The boundary amorphous phase dissolves M elements such as Zr, Hf and Nb released from α-Fe by the annealing temperature rises and suppresses formation of Fe—M-system compounds which deteriorate soft magnetic characteristics. Thus, an addition of B to the Fe—Zr(Hf)-base alloy is important.

At an amount of B represented by suffix x of 0.5 atomic percent or less, the boundary amorphous phase is unstable and the effects by the addition are insufficient. At an amount x of 18 atomic percent or more, borides of Fe and M readily form, and it is difficult to find an optimum annealing condition for achieving a fine crystal grain phase and excellent magnetic characteristics. An addition of an adequate amount of B permits control of the average grain size in the precipitated fine crystal grain phase within a range of 30 nm or less.

It is preferable that the alloy contain any one of Zr, Hf and Nb which have high amorphous-phase formability in order to promote the formation of the amorphous phase. Any one of Ti, V, Ta, Mo and W among other Groups 4A to 6A can be partially substituted for Zr, Hf or Nb. These M elements act as species having relatively low diffusion rates, and an addition of the M element decreases the growth rate of fine crystal nuclei and promote formation of an amorphous phase. Therefore, these M elements are effective for fine microstructure.

At an amount y of M element of 4 atomic percent or less, the growth rate of nuclei does not noticeably decrease and coarse crystal grains form. Thus, excellent magnetic characteristics cannot be achieved. In Fe—Hf—B-system alloys, an alloy containing 5 atomic percent of Hf has an average grain size of 13 nm, whereas an alloy containing 3 atomic percent of Hf has a larger average grain size of 39 nm. At an amount y of M element of 9 atomic percent or more, since M—B or Fe—M compounds tend to form, the alloy does not have excellent magnetic characteristics, and the alloy ribbon after liquid quenching is too brittle to form into a given core shape. Therefore, suffix y is in a range of 4 to 9 atomic percent.

In particular, Nb and Mo having low absolute free energies for oxide formation are thermally stable, and barely oxidized during production. Thus, an addition of such elements conducts ready production of alloys with a low cost. Soft magnetic alloys containing these elements can be produced in the atmosphere or in an atmospheric environment while partly supplying an inert gas to the tip of a crucible nozzle used for quenching the melt.

It is preferred that the alloy contain 4 atomic percent or less of at least one element selected from the group consisting of Si, Al, Ge and Ga. These elements are known as metalloid or semi-metal elements and dissolved into a bcc (body-centered cubic) crystal phase essentially consisting of Fe. Amounts of the elements over 4 atomic percent increase electrical resistance of soft magnetic alloys, and decrease iron loss. Such effects are pronounced in Al. Ge and Ga form finer crystal grains. Therefore, the addition, of Al, Ge or Ga have pronounced effects. It is preferable that Al and Ge, Al and Ga, Ge and Ga, or Al, Ge and Ga be used in combination, as well as a single addition of Al, Ge or Ga.

An alloy containing 4.5 atomic percent of at least one element (T) selected from the group consisting of Cu, Ag, Au, Pd and Pt has superior magnetic characteristics. These elements do not dissolve into Fe, thereby causing an inhomogeneous composition and form clusters at an initial crystallization stage by a trace amount of addition. As a result, Fe-enriched regions form and promote nucleation of $\alpha$-Fe. According to differential scanning calorimetry, the addition of these elements such as Cu and Ag slightly decreases the crystallization temperature of the alloy, probably due to formation of an inhomogeneous amorphous phase and thus decreased stability of the amorphous phase. In crystallization of inhomogeneous amorphous phase, inhomogeneous nuclei form at many crystallizable sites and a microstructure containing fine crystal grains forms. Other elements decreasing the crystallization temperature will also be effective from such a viewpoint.

The alloy may contain platinum elements, such as Cr, Ru, Rh and Ir, in order to improve corrosive resistance. Since an excessive amount of over 5 atomic percent significantly decreases saturation magnetic flux density, the amounts of these elements must be 5 atomic percent or less in the alloy.

The soft magnetic alloy may contain other elements, such as Y, La, Ce, Pr, Nd, Pm, Sm, Eu, Gd, Tb, Dy, Ho, Er, Tm, Yb, Lu, Zn, Cd, In, Sn, Pd, As, Sb, Bi, Se, Te, Li, Be, Mg, Ca, Sr and Ba, for controlling magnetostriction, if necessary.

The soft magnetic alloy in accordance with the present invention may also contain incidental impurities, such as H, N, O and S, within the scope not deteriorating magnetic characteristics.

EXAMPLES

(Example 1)

An amorphous alloy ribbon in accordance with the present invention having a composition of $Fe_{84}Nb_{3.5}Zr_{3.5}B_8Cu_1$ was prepared with a production apparatus as shown in FIG. 1. The apparatus is provided with a chamber 10 which consists of a prismatic main body 13 including a cooling roll 3 and a crucible 12 and a reserving section 14. The main body 13 and the reserving section 14 are joined to each other with bolts through flange sections 13*a* and 14*a* which are hermetically sealed. The main body 13 is provided with an exhausting tube 15 connected with a vacuum evacuating system.

The cooling roll 3 is supported by a rotating axis 11 crossing both side walls of the chamber 10 and driven by a motor provided at the exterior of the chamber 10 and not shown in the drawing.

The crucible 12 is provided with a nozzle 6 at the bottom and a heating coil 9, and contains an alloy melt 2.

The upper section of the crucible 12 is connected to a gas supply source 18 for supplying a gas such as Ar through a supply pipe 16 provided with a pressure-control valve 19, a solenoid valve 20 and a pressure gauge 21 therebetween. An auxiliary pipe 23 is provided on a parallel with the supply pipe 16. The auxiliary pipe 23 is provided with a pressure-control valve 24, a flow-control valve 25 and a flow meter 26. The gas supply source 18 supplies a gas such as Ar into the crucible 12 to eject the alloy melt 2 onto the cooling roll 3 through the nozzle 6. The chamber 10 is provided with a gas supply source 31 for supplying an Ar gas or the like from the ceiling of the chamber 10 through a connecting pipe 32 provided with a pressure-control valve 33.

In the production of the alloy ribbon, the chamber 10 is evacuated while a nonoxidative gas such as Ar is fed to the chamber through the gas supply source 31. Gaseous Ar is fed into the crucible 12 from a gas supply source 18 to eject the alloy melt 2 from the nozzle 6 while rotating the cooling roll 3. The alloy melt 2 is discharged onto the surface of the cooling roll 3 along the rotation direction to form an alloy ribbon 4.

The alloy ribbon 4 is continuously produced by continuously discharging the alloy melt 2 onto the rotating cooling roll 3 and conducted to the reserving section 14 of the chamber 10. The gaseous Ar in the chamber 10 prevents oxidation of the alloy ribbon due to heat inertia.

After the alloy ribbon 4 continuously produced is cooled to near room temperature, it is removed from the reserving section 14 of the chamber 10 by separating the reserving section 14 from the main body 13.

Figure 2:
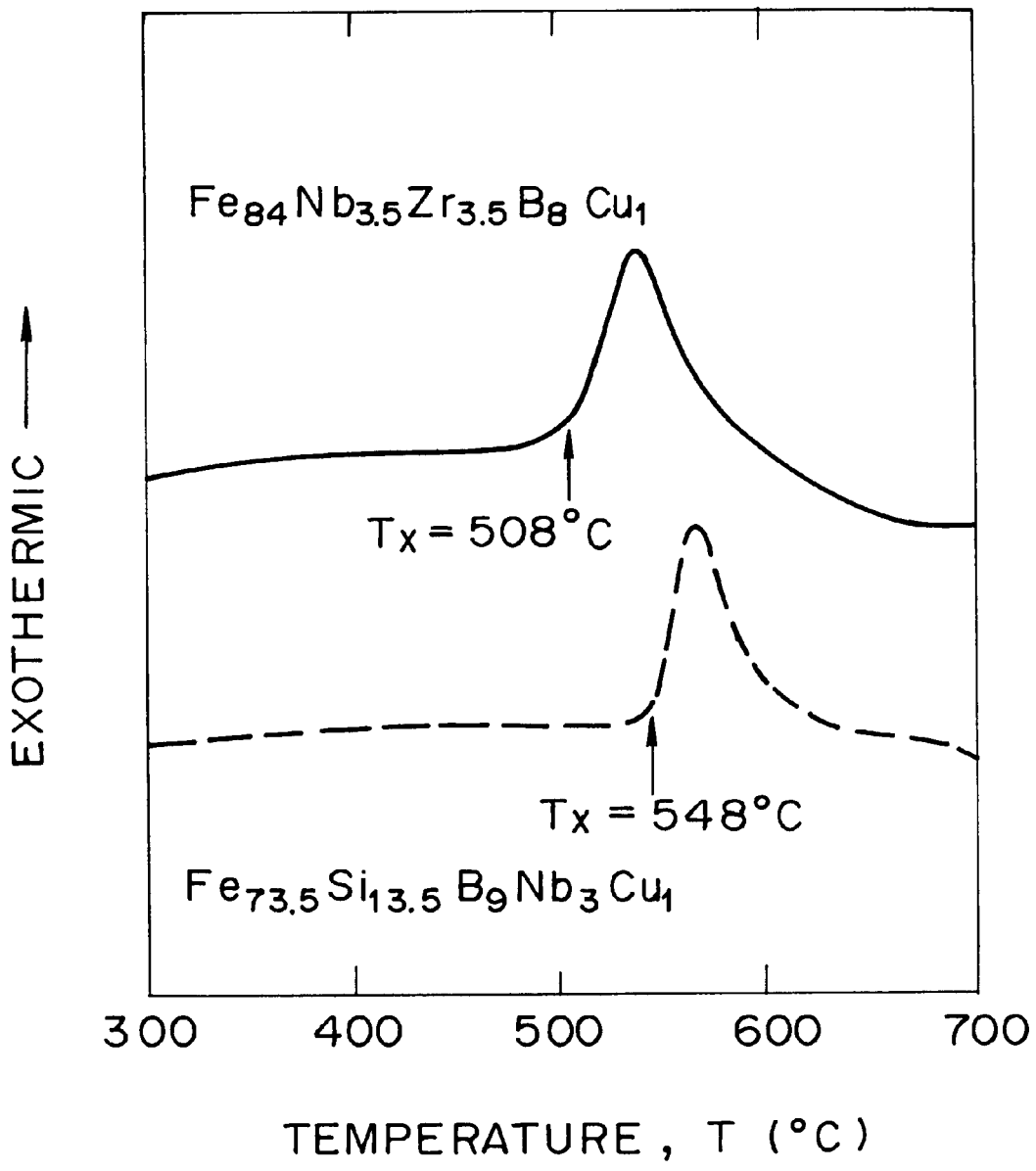
FIG. 2 is a graph including DSC thermograms in accordance with an example and a comparative example.

The resulting amorphous alloy ribbon having a width of 15 mm and a thickness of 20 $\mu$m was subjected to crystallization temperature measurement with a differential scanning calorimeter (DSC) at a heating rate of 40° C./min. The DSC thermogram obtained is shown with a solid line in FIG. 2. The thermogram in FIG. 2 demonstrates that the first crystallization temperature $T_x$ of the amorphous alloy ribbon is approximately 508° C. at a heating rate of 40° C./min.

(Comparative Example 1)

An amorphous alloy ribbon having a composition of $Fe_{73.5}Si_{13.5}B_9Nb_3Cu_1$ was prepared as an example out of the range of the present invention as in Example 1.

The resulting amorphous alloy ribbon was subjected to crystallization temperature measurement with a differential scanning calorimeter at a heating rate of 40° C./min. The DSC thermogram obtained is shown with a broken line in FIG. 2. The thermogram demonstrates that the first crystallization temperature $T_x$ of the amorphous alloy ribbon is approximately 548° C.

The amorphous alloy ribbons of Example 1 and Comparative Example 1 were annealed during various annealing time periods t and subjected to measurement of magnetic characteristics, i.e., permeability $\mu'$ at 1 kHz, coercive force Hc (Oe), saturation magnetostriction $\lambda s$ and average grain size D (nm).

The annealing program of the amorphous alloy ribbon included heating to the annealing temperature $T_a$ at a heating rate of 40° C./min., holding at the annealing temperature for a given time period and then cooling. Herein, the annealing temperature $T_a$ of each sample was set at a temperature slightly higher than the first crystallization temperature, i.e., 510° C. for $Fe_{84}Nb_{3.5}Zr_{3.5}B_8Cu_1$ (Example 1) and 550° C. for $Fe_{73.5}Si_{13.5}B_9Nb_3Cu_1$ (Comparative Example 1).

Figure 3:
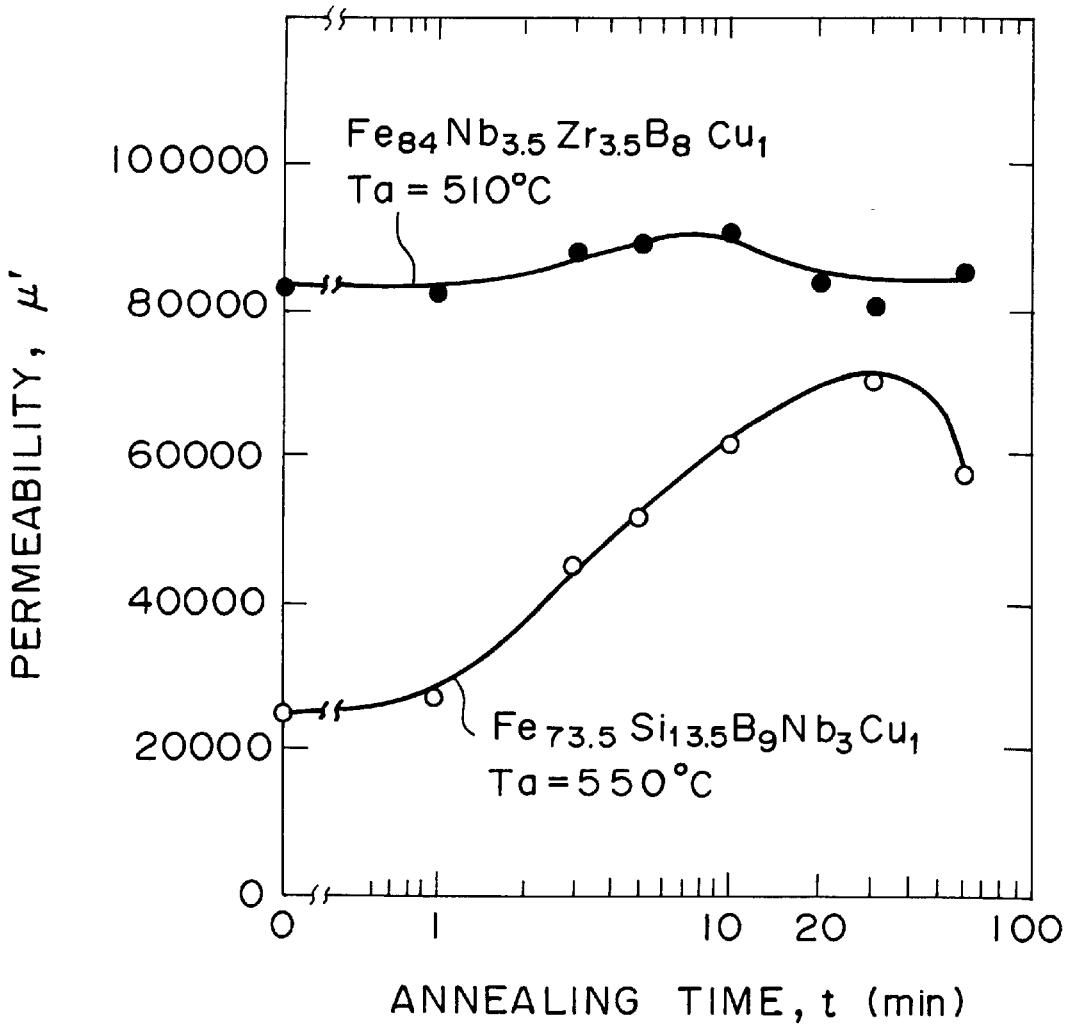
FIG. 3 is a graph illustrating the correlation between the annealing time and the permeability in accordance with an example and a comparative example.
Figure 4:
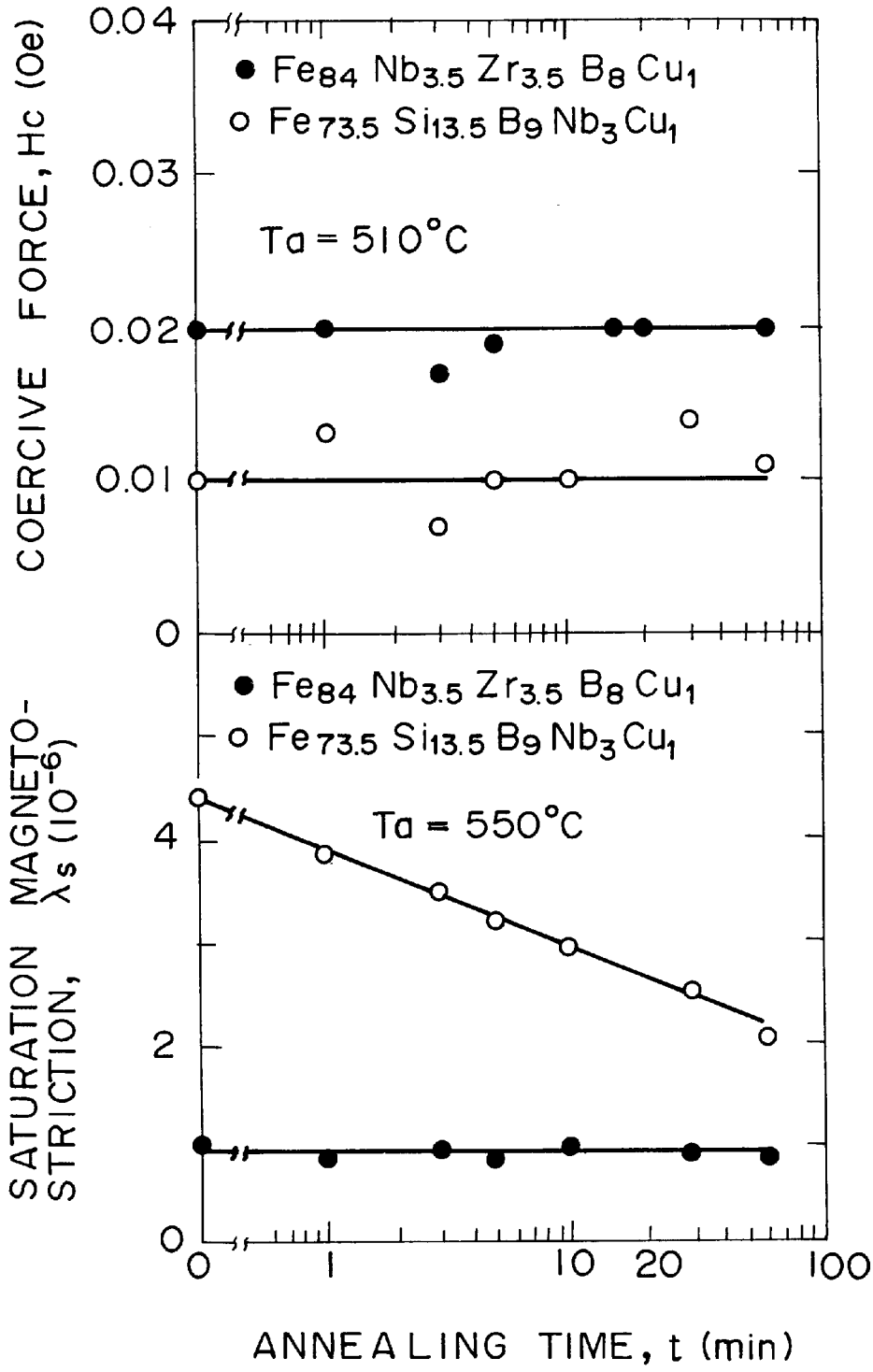
FIG. 4 is a graph illustrating the correlation between the annealing time and the coercive force or saturation magnetostriction in accordance with an example and a comparative example.
Figure 5:
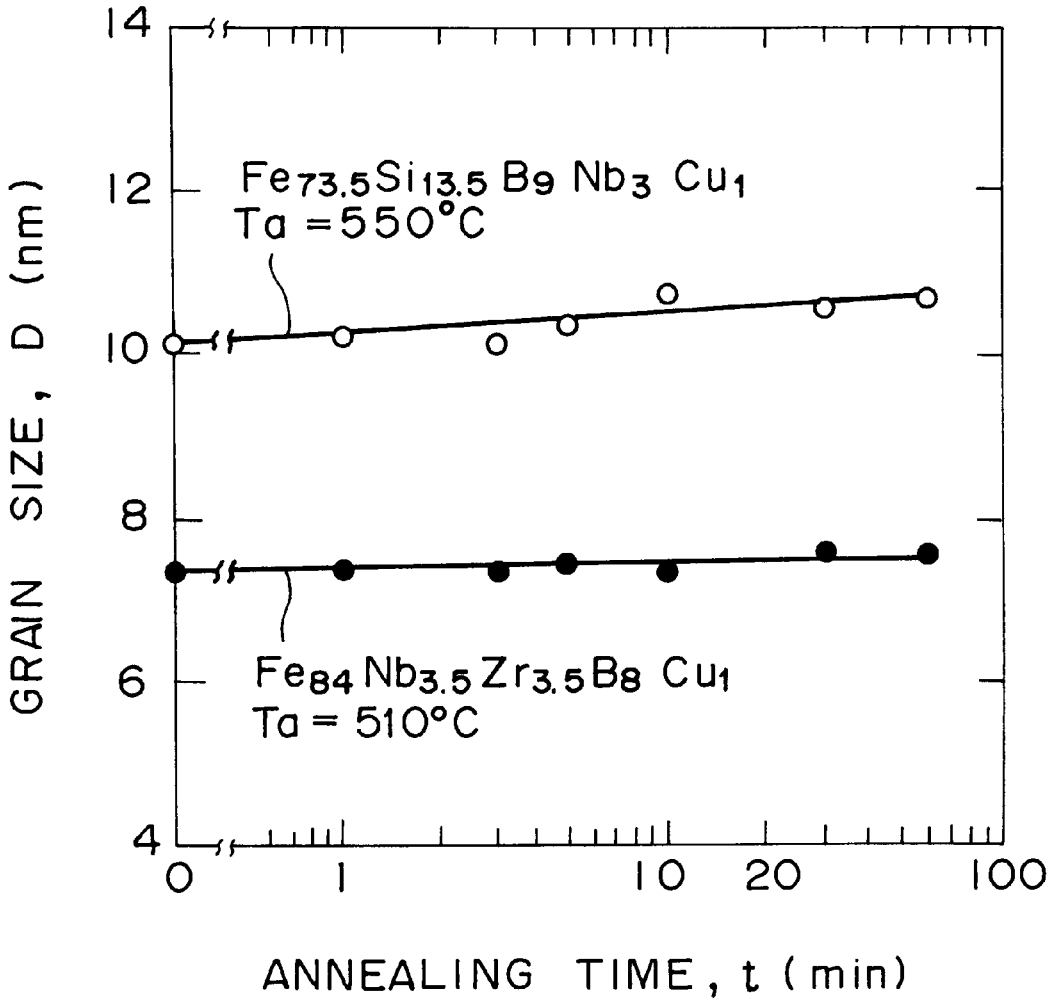
FIG. 5 is a graph illustrating the correlation between the annealing time and the grain size in accordance with an example and a comparative example.

The results are shown in FIGS. 3 to 5, wherein the symbol ● represents Example 1 and the symbol ○ represents Comparative Example 1.

The results in FIG. 3 demonstrate that the alloy ribbon of Example 1 always has high permeability values at relatively short annealing time periods, whereas the alloy ribbon of Comparative Example 1 has a maximum permeability value at an annealing time period of 30 minutes and drastically decreased permeability values at shorter annealing time periods.

The results in FIG. 4 demonstrate that the coercive forces Hc of the alloy ribbons of Example 1 and Comparative Example 1 are almost the same and do not substantially change with the annealing time period. The saturation magnetostriction $\lambda s$ of Comparative Example 1 increases with the decreased time period, whereas that of Example 1 is always significantly low at shorter time periods of 0 to 20 minutes and lower than that of Comparative Example 1.

The results in FIG. 5 demonstrate that the average grain sizes D of the alloy ribbons of Example 1 and Comparative Example 1 do not substantially change with the annealing time period, and the alloy ribbon of Example 1 has finer crystal grains than the alloy ribbon of Comparative Example 1.

Accordingly, the alloy ribbon of Example 1 is almost the same as Comparative Example 1 in coercive force, is superior to Comparative Example 1 in permeability and saturation magnetostriction. In Example 1, finer crystal grains improve magnetic characteristics.

Figure 6:
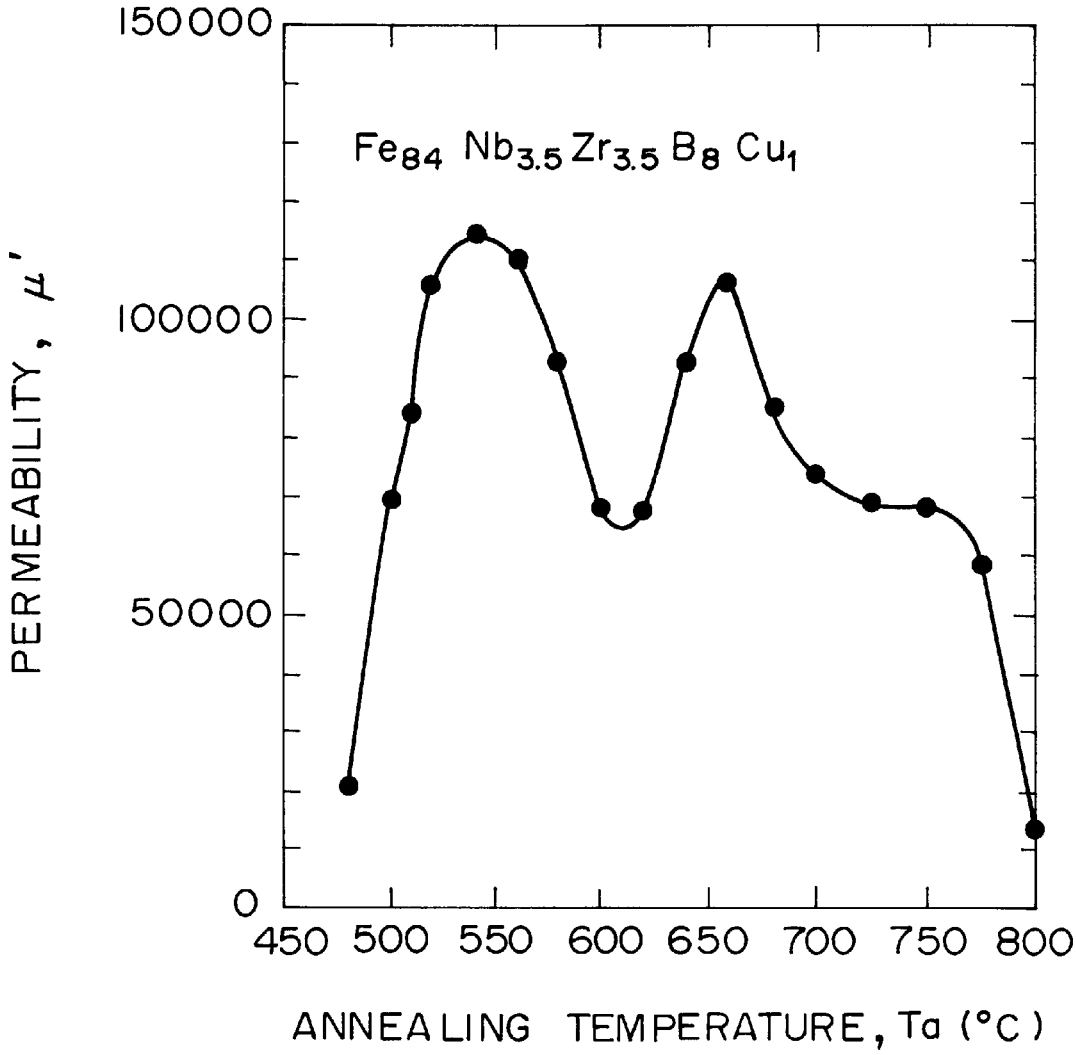
FIG. 6 is a graph illustrating the correlation between the annealing temperature and the permeability in accordance with an example.

The amorphous alloy ribbon of Example 1 was annealed at various annealing temperature $T_a$ for an annealing time of 0 minutes to measure permeability $\mu'$ at 1 kHz. The sample was heated to the annealing temperature $T_a$ at a heating rate of 40° C./min. and then immediately cooled without holding at the annealing temperature. The annealing temperature $T_a$ was varied between 480° C. and 800° C. The results are shown in FIG. 6. The results demonstrate that the amorphous alloy ribbon of Example 1 has high permeability by annealing at a temperature ranging from 500° C. to 775° C. even at no annealing time period.

Figure 7:
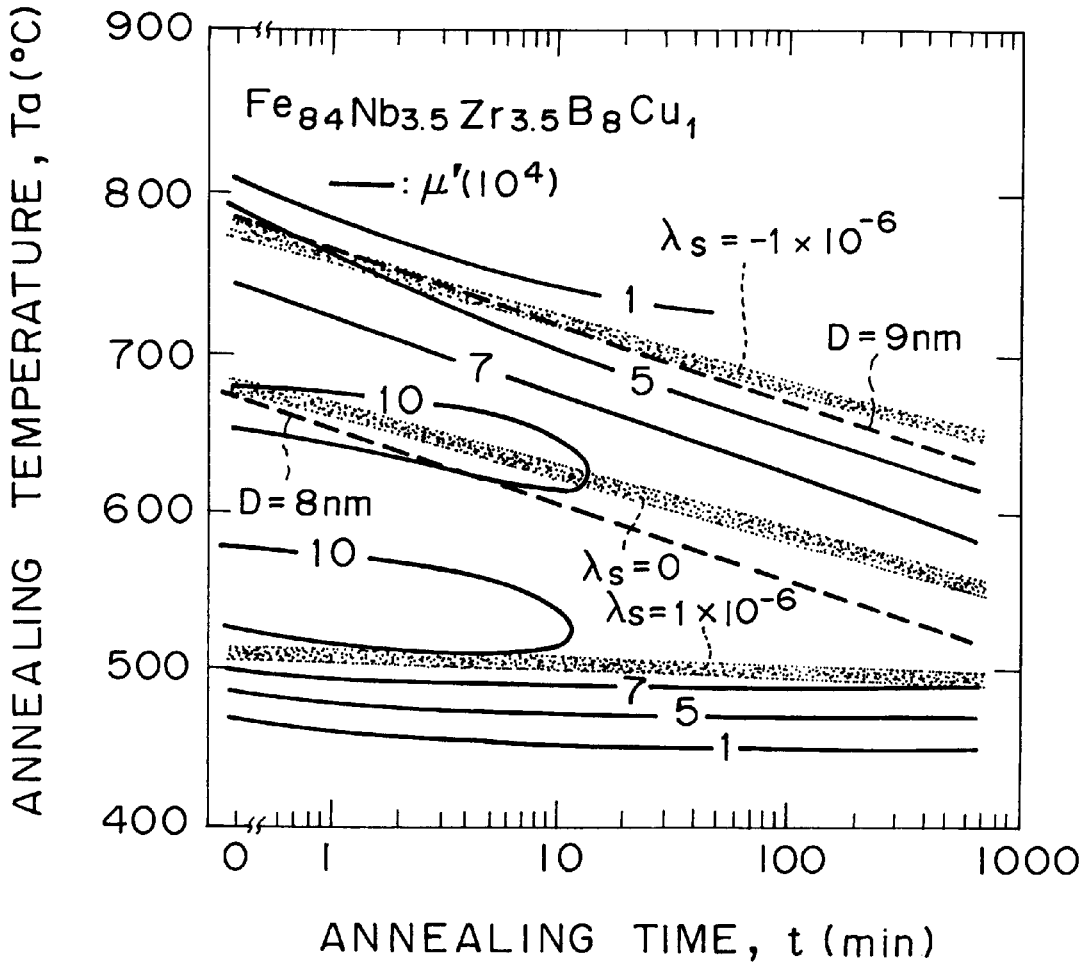
FIG. 7 is a graph illustrating the distributions of permeability $\mu'$, grain size D and magnetostriction $\lambda s$ at different annealing temperatures and times in an alloy having a composition of $Fe_{84}Zr_{3.5}Nb_{3.5}B_8Cu_1$.

FIG. 7 is a graph illustrating changes in permeability $\mu'$ at 1 k Hz (solid lines), magnetostriction $\lambda s$ (hatched lines) and average grain size D (broken lines) with the annealing temperature $T_a$ and the annealing time t of the amorphous alloy ribbon.

The results in FIG. 7 demonstrate that a high permeability of $10\times10^4$ or more is achieved at annealing temperatures ranging from approximately 500° C. to 580° C. and from 600° C. to 680° C. when the annealing temperature is set to 10 minutes or less. The alloy ribbon has an average grain size of 8 nm or less under such conditions and a magnetostriction of substantially zero at an annealing temperature of 600° C. to 680° C. for an annealing time of 10 minutes or less. Further, a high permeability of $5\times10^4$ or more is achieved by setting the annealing time to zero even at a high annealing temperature near 800° C.

Permeability decreases at an annealing time of 10 minutes or more in spite of an average grain size near 8 nm and a magnetostriction of zero, this being probably due to a wide spread grain size distribution (although the average grain size does not change) caused by nucleation promoted by an inhomogeneous composition.

(Example 2)

An amorphous alloy ribbon having the nominal formula of $Fe_{84}Nb_7B_9$ in accordance with the present invention was prepared as in Example 1.

(Example 3)

An amorphous alloy ribbon having the nominal formula of $Fe_{90}Nb_7B_3$ in accordance with the present invention was prepared as in Example 1.

The amorphous alloy ribbons of Examples 2 and 3 were annealed with various annealing times (t) to measure their respective permeabilities $\mu'$ at 1 kHz of the resulting soft magnetic alloys.

The annealing program of each alloy included heating to a given annealing temperature $T_a$ at a heating rate of 180° C./min., holding at the annealing temperature $T_a$ for a predetermined time period, and cooling. The annealing temperature $T_a$ was set at a temperature higher than the first crystallization temperature of the alloy and lower than the second crystallization temperature, i.e., 650° C. for $Fe_{84}Nb_7B_9$ (Example 2) or 600° C. for $Fe_{90}Zr_7B_3$ (Example 3).

Figure 8:
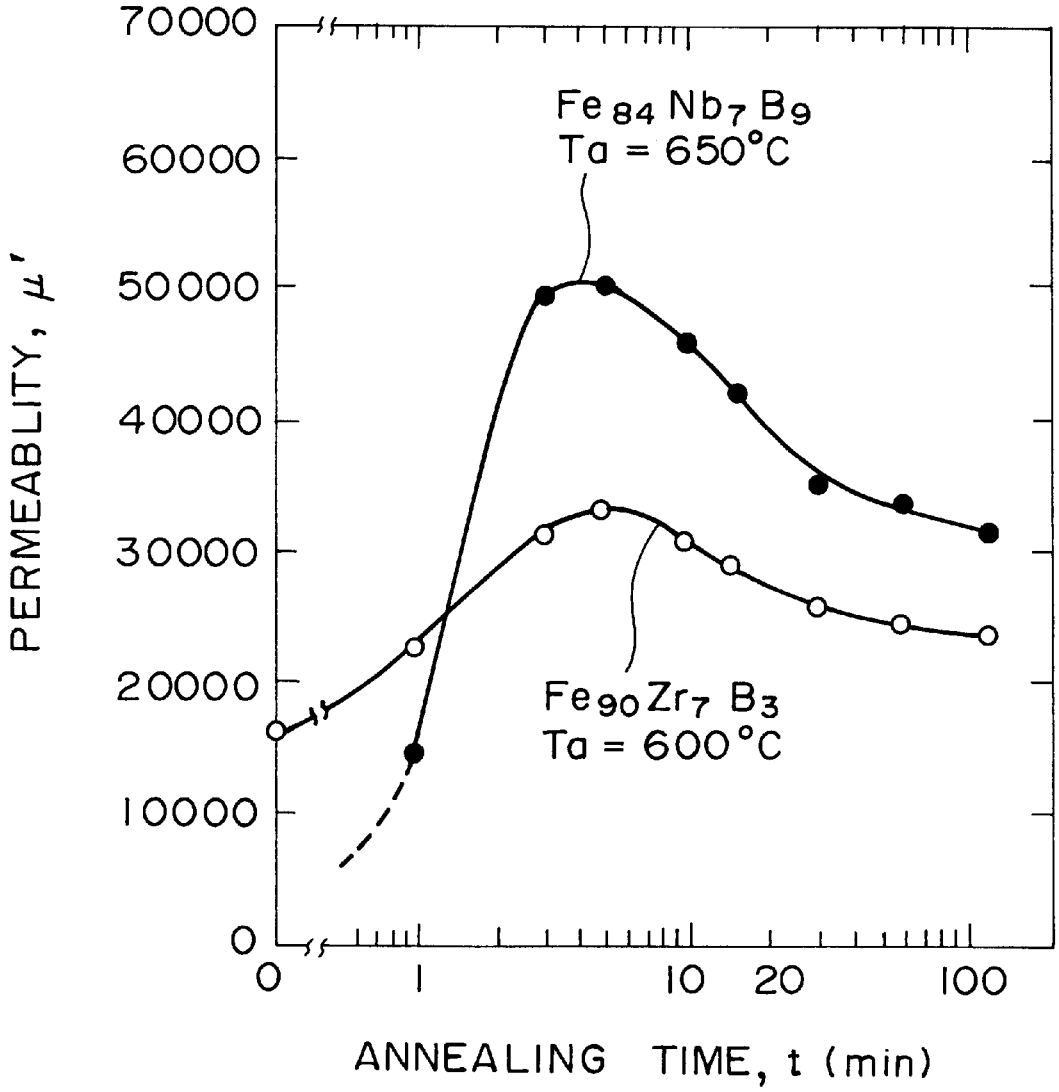
FIG. 8 is a graph illustrating the correlation between the annealing temperature and the permeability in accordance with other examples.

The results are shown in FIG. 8, wherein the symbols ● and ○ represent Example 2 and Example 3, respectively. The results demonstrate that the soft magnetic alloy of Example 2 has a high permeability at an annealing time in a range of 1 minute to 120 minutes, and preferably 2 minutes to 30 minutes, and the alloy of Example 3 has a high permeability at an annealing time in a range of 0 minutes to 120 minutes, and preferably 2 minutes to 30 minutes.

Figure 9:
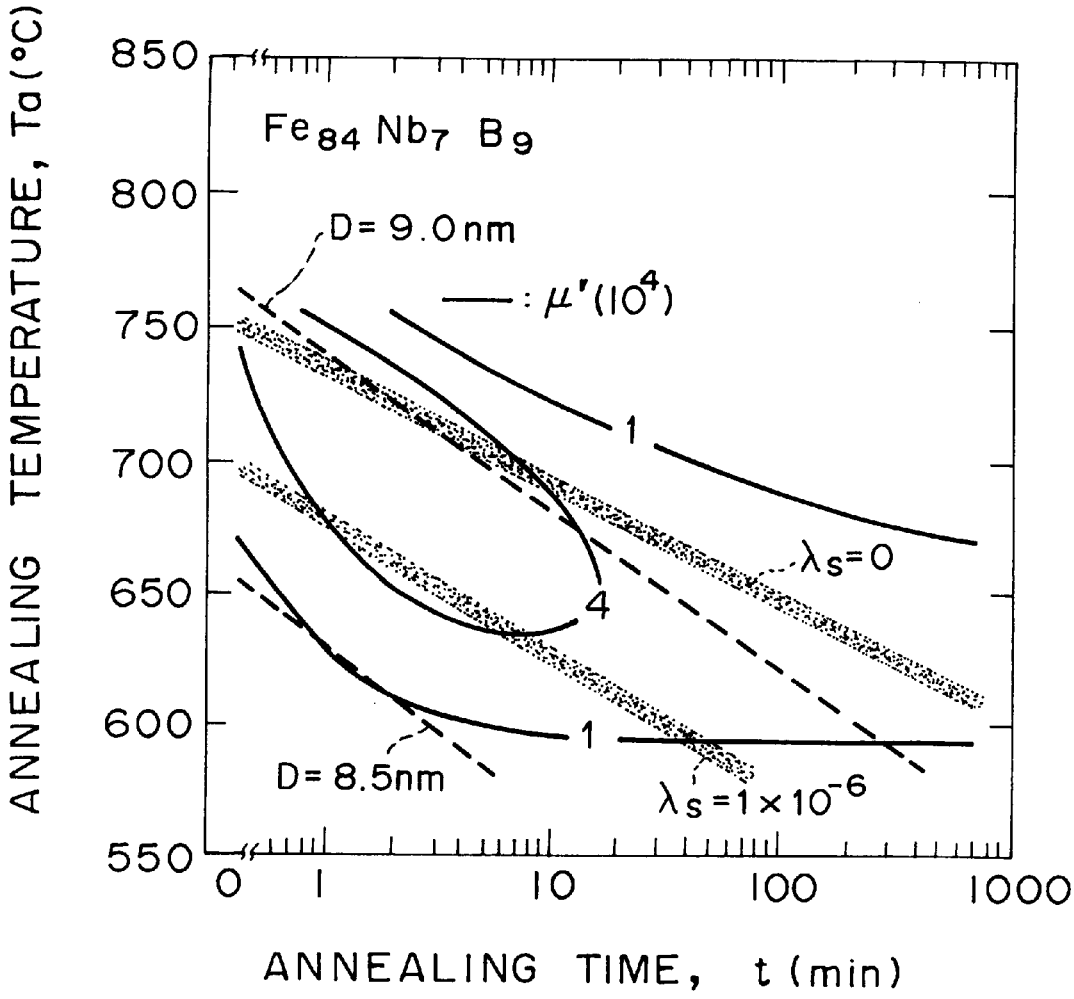
FIG. 9 is a graph illustrating the distributions of permeability $\mu'$, magnetostriction $\lambda s$ and crystal grains D at different annealing temperatures and times in an alloy having a composition of $Fe_{84}Nb_7B_9$.
Figure 10:
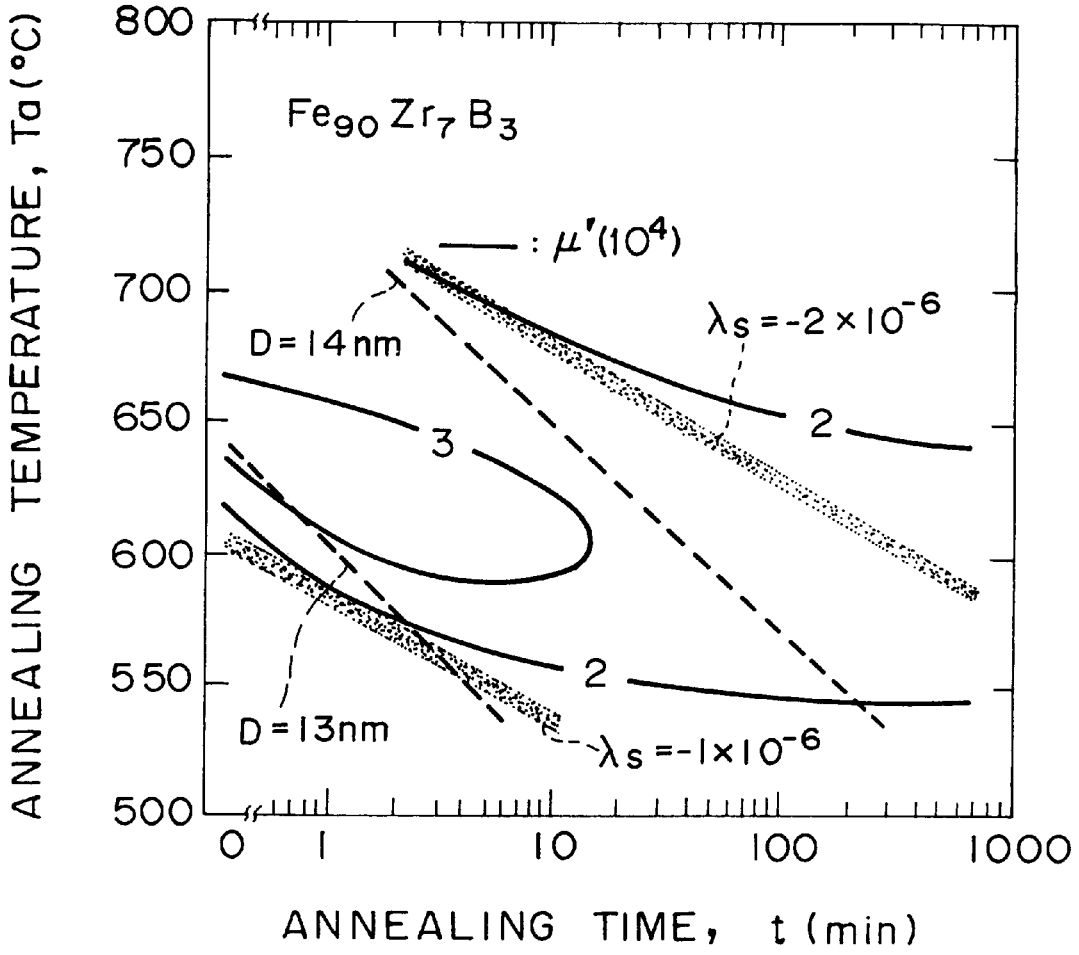
FIG. 10 is a graph illustrating the distributions of permeability $\mu'$, magnetostriction $\lambda s$ and crystal grains D at different annealing temperatures and times in an alloy having a composition of $Fe_{90}Zr_7B_3$.

FIGS. 9 and 10 show changes in permeability $\mu'$ (solid line), magnetostriction $\lambda s$ (hatched line) and average grain size D (broken line) with annealing temperature and time of the amorphous alloy ribbons of Examples 2 and 3, respectively.

FIG. 9 demonstrates that the permeability of the alloy of Example 2 is $4\times10^4$ or more at 1 MHz and significantly high at an annealing time in a range of 0 to 20 minutes and an annealing temperature in a range of 630 to 760° C. Further, the average crystal grain size is 9 nm or less and the magnetostriction is zero within this range. The permeability also deteriorates at a longer annealing time even when the average crystal grain size is 9 nm or less and the magnetostriction is zero, as in FIG. 7 for Example 1.

FIG. 10 demonstrates that the permeability of the alloy of Example 3 is $3\times10^4$ or more at 1 MHz and significantly high at an annealing time in a range of 0 to 20 minutes and an annealing temperature in a range of 580 to 670° C. Further, the average crystal grain size is 14 nm or less and the magnetostriction is $-1\times10^{-6}$ to $-2\times10^{-6}$ within this range. The permeability also deteriorates at a longer annealing time within the above-mentioned annealing temperature, as in Examples 1 and 2.

What is claimed is:

1. A method for making a Fe-based soft magnetic alloy comprising the steps of:

injecting an alloy melt onto a moving cooling unit to form an amorphous alloy ribbon, wherein said alloy melt is represented by the general formula: $Fe_bB_xM_yT_dX_z$ wherein M is at least one element selected from the group consisting of Ti, Zr, Hf, V, Nb, Ta, Mo and W, T is at least one element selected from the group consisting of Cu, Ag, Au, Pd and Pt, X is at least one element selected from the group consisting of Al, Ge and Ga, the composition ratios, b, x, y, d and z, are in ranges of $75 \leqq b \leqq 93$ atomic percent, $0.5 \leqq x \leqq 18$ atomic percent, $4 \leqq y \leqq 9$ atomic percent, $d \leqq 4.5$ atomic percent, and $z \leqq 4$ atomic percent, respectively, and wherein the composition of said alloy melt is selected such that said amorphous alloy ribbon is characterized by a first crystallization temperature at which a fine grain phase precipitates, and a second crystallization temperature at which a compound phase precipitates; and annealing said amorphous alloy ribbon by heating said amorphous alloy ribbon at a heating rate of 40 to 200° C./min from room temperature to an annealing temperature ranging from 500 to 800° C. which is higher than the first crystallization temperature, and less than the second crystallization temperature, by holding said amorphous alloy ribbon at the annealing temperature for an annealing time in the range of 2 minutes to 10 minutes, and by cooling the alloy ribbon to room temperature to precipitate a fine grain phase having an average grain size of 30 nm or less, in which at least 50% of said fine grain phase comprises Fe crystallites.

2. A method for making a Fe-base soft magnetic alloy according to claim 1, wherein said compound phase comprises one of $Fe_3B$ and $Fe_3M$ precipitates.

* * * * *

UNITED STATES PATENT AND TRADEMARK OFFICE

CERTIFICATE OF CORRECTION

PATENT NO. : 6,083,325
DATED : July 4, 2000
INVENTOR(S) : Teruo Bitoh et al.

It is certified that error appears in the above-identified patent and that said Letters Patent is hereby corrected as shown below:

Title page,
Item [73], after "Japan" insert --; Japan Science and Technology Corporation, Saitama, Japan; Akihisa Inoue, Miyagi, Japan; Tsuyoshi Masumoto, Miyagi, Japan --.

Claim 2,
Line 1, change "Fe-base" to -- Fe-based --.

Signed and Sealed this

Twenty-fifth Day of December, 2001

*Attest:*

*Attesting Officer*

JAMES E. ROGAN
*Director of the United States Patent and Trademark Office*